United States Patent [19]

Schoeps

[11] Patent Number: 4,767,379

[45] Date of Patent: Aug. 30, 1988

[54] HYDRAULIC TORQUE IMPULSE GENERATOR

[75] Inventor: Knut C. Schoeps, Tyresö , Sweden

[73] Assignee: Atlas Copco Aktiebolag, Nacka, Sweden

[21] Appl. No.: 103,355

[22] Filed: Sep. 30, 1987

[30] Foreign Application Priority Data

Oct. 3, 1986 [SE] Sweden ..... 8604208

[51] Int. Cl.[4] ..... B25B 21/02; B25D 15/00

[52] U.S. Cl. ..... 464/25; 173/93.5

[58] Field of Search ..... 173/93, 93.5, 94, 90; 464/24, 25

[56] References Cited

U.S. PATENT DOCUMENTS

| | | | |
|---|---|---|---|
| 3,214,941 | 11/1965 | Shulters | 464/25 |
| 3,263,449 | 8/1966 | Kramer | 464/25 |
| 3,552,499 | 1/1971 | Maurer | 173/93.5 X |
| 3,734,205 | 5/1973 | Maurer | 173/93.5 |
| 4,347,902 | 9/1982 | Wallace et al. | 173/93.5 |
| 4,553,948 | 11/1985 | Tatsuno | 464/25 |

*Primary Examiner*—Daniel P. Stodola

*Attorney, Agent, or Firm*—Frishauf, Holtz, Goodman & Woodward

[57] ABSTRACT

A hydraulic torque impulse generator comprises a drive member (10) drivingly connected to rotation motor and including a cylindrical fluid chamber (11) which is partly defined by a circumferential wall (23) of a non-constant radius, an output spindle (12) rotatably supported in a coaxial relationship with said drive member (10) and comprising a rear portion (13) which extends into said fluid chamber (11) and which has two radial slots (29, 30) in which seal rollers (27, 28) are radially movable. The drive member (10) has a rear end wall (20) which is formed with a forwardly extending hub portion (25) on which is rigidly attached a cam element (26) for positive engagement with the seal rollers (27,28) to move the latters outwardly toward the fluid chamber wall (23) during rotation of said drive member (10) relative to said output spindle (12).

8 Claims, 1 Drawing Sheet

HYDRAULIC TORQUE IMPULSE GENERATOR

BACKGROUND OF THE INVENTION

This invention relates to a hydraulic torque impulse generator, comprising a drive member connected to a rotation motor, a cylindrical fluid chamber in said drive member partly defined by a circumferential wall of a nonconstant radius, an output spindle rotatably supported in a coaxial relationship with said drive member and comprising a rear portion which extends into said fluid chamber, said rear spindle portion having one or more radial slots each supporting a radially movable seal element for sealing cooperation with seal ridges on said fluid chamber wall, thereby dividing said fluid chamber into one or more high pressure compartments and one or more low pressure compartments during short intervals of the relative rotation between said drive member and said output spindle.

In U.S. Pat. Nos. 3,214,941, 3,263,449, and 4,553,948 there are shown and described hydraulic impulse generators with a various number of seal elements which are radially movable in slots in the rear spindle portion so as to maintain a continuous contact with the fluid chamber wall during relative rotation between the drive member and the output spindle. In order to ensure a proper sealing contact between the movable seal elements and the fluid chamber wall there are employed springs to exert radially directed bias forces upon the seal elements. This means that there is always a contact pressure between the seal elements and the fluid chamber wall, also when no sealing cooperation between the seal elements and the fluid chamber wall is to be established. Accordingly, one problem concerned with the above described previous impulse generators relates to mechanical wear of the seal elements in their contact with the fluid chamber wall.

The main object of the present invention is to substantially reduce the mechanical wear of the seal elements. This is obtained by the invention as it is characterized in the claims.

An embodiment of the invention is described in detail with reference to the accompanying drawing figures.

DETAILED DESCRIPTION

Figure 1:
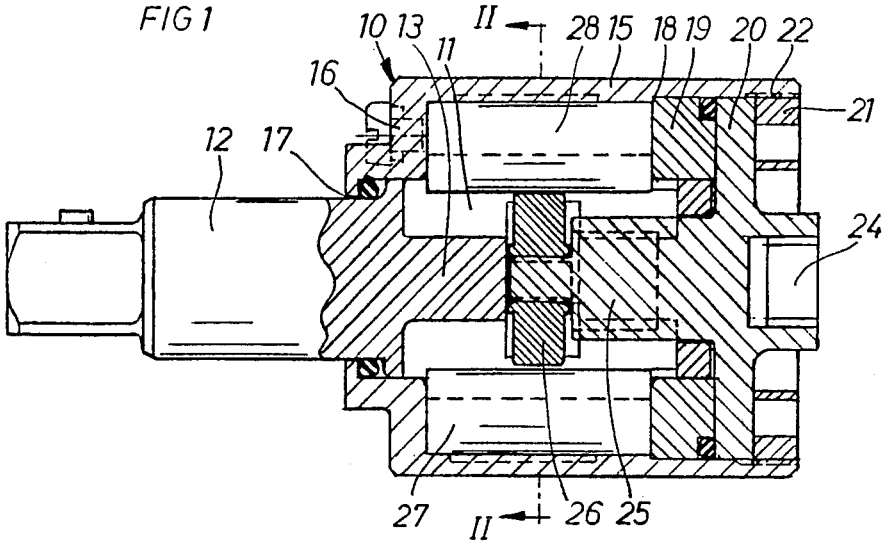
FIG. 1 shows a longitudinal section through an impulse generator according to the invention.

The torque impulse generator shown on the drawing comprises a drive member 10 which confines a cylindrical fluid chamber 11 and an output spindle 12. The latter is formed with a rear impulse receiving portion 13 which comprises a coaxial bore 14 and extends into the fluid chamber 11. The drive member 10 comprises a cylinder 15 which at its forward end has a transverse end wall 16. The latter has a central opening 17 through which the output spindle 12 extends. The cylinder 15 is formed with an internal shoulder 18 against which a ring element 19 and the rear end wall 20 of the drive member 10 are clamped by a nut 21 which engages an internal thread 22 in the cylinder 15. The rear end wall 20 is formed with a central socket portion 24 by which the drive member 10 is connectable to the drive shaft of a rotation motor. The rear end wall 20 also has a forwardly extending hub portion 25 which extends into the bore 14 of the rear end portion 13 of the output spindle 12. On the hub portion 25 there is rigidly attached a cam element 26 which is arranged to act upon two seal rollers 27, 28 which are radially slidable in diametrically opposite slots 29, 30 in the spindle portion 13. The slots 29, 30 are open into the coaxial bore 14.

Figure 2:
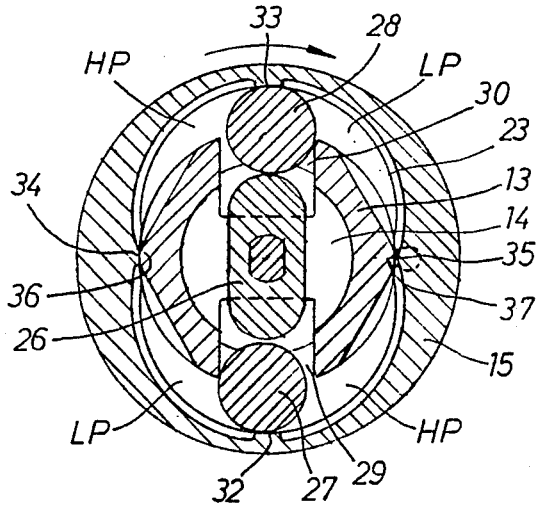
FIG. 2 shows a cross section along line II—II in FIG. 1.

As appears from FIG. 2, the fluid chamber 11 of the drive member 10 has a circumferential wall 23 of a non-constant radius. In the fluid chamber 11 there are two diametrically opposed seal lands 32, 33 for sealing cooperation with the seal rollers 27, 28 and two diametrically opposed seal ridges 34, 35 which are angularly spaced from the seal lands 32, 33 by 90°. The seal ridges 34, 35 are arranged to cooperate with two diametrically opposed seal ridges 36, 37 on the rear spindle portion 13.

Owing to the fact that the seal ridges 34–37 and seal lands 32, 33 of the drive member 10 and the output spindle 12 are symmetrically disposed, there would be a sealing engagement between the drive member 10 and output spindle 12 once every half relative rotation between the latters. Such a seal position is shown in FIG. 2. During rotation of the drive member 10 in the direction illustrated by the arrow in FIG. 2, there are enclosed two high pressure compartments H.P. of the fluid chamber 11 and two low pressure compartments L.P. The pressure peaks generated in the high pressure compartments H.P. will induce tangential forces on the seal rollers 27, 28 to, thereby accomplishing a torque impulse in the output spindle 12.

The cam element 26 is active to move the seal rollers 27, 28 outwardly toward the fluid chamber wall 23. It is not, however, arranged to establish a contact pressure between the seal rollers 27, 28 and the fluid chamber wall 23. There will always be a small gap left between the cam element 26 and the rollers 27, 28 or between the rollers and the fluid chamber wall. A sealing contact between the rollers 27, 28 and the lands 32, 33 is obtained by the hydraulic fluid pressure acting under the rollers 27, 28. The latters are guided in the radial slots 29, 30 in the spindle portion 13 with a clearance which means that fluid from the high pressure compartments H.P. will reach the slots and make the rollers 27, 28 obtain a desired sealing contact with the lands 32, 33.

By employing a cam element for moving the seal elements outwardly toward their sealing positions it is possible to avoid the problems concerned with prior technique where springs are used. Springs are not only exposed to a fatigue strain which will influence upon their service life they also cause a frictional wear of the seal elements.

Though the invention is described by example of an impulse generator having roller shaped seal elements it is not at all limited to that particular embodiment. Accordingly, an impulse generator having vanes as seal elements is equally comprised by the invention.

I claim:

1. In a hydraulic torque impulse generator, comprising a drive member (10) connected to a rotation motor, a cylindrical fluid chamber (11) in said drive member (10) partly defined by a circumferential wall (23) of a non-constant radius, an output spindle (12) rotatably supported in a coaxial relationship with said drive member (10) and comprising a rear portion (13) which extends into said fluid chamber (11), said rear spindle portion (13) having at least one radial slot (29, 30) each supporting a radially movable seal element (27, 28) for sealing cooperation with seal lands (32, 33) on the fluid chamber wall (23), and at least one seal ridges (36, 37) on said rear spindle portion (13) for sealing cooperation with seal ridges (34, 35) on said fluid chamber wall (23), thereby dividing said fluid chamber (11) into at least one high pressure compartment (H.P.) and at least one low pressure compartment (L.P.) during short intervals of the relative rotation between said drive member (10) and said output spindle (12), the improvement wherein:

said rear spindle portion (13) comprises a coaxial bore (14) which partly coincides with said radial slots (29, 30), a cam element (26) is rotatably supported in said bore (14), and said cam element (26) being non-rotatably connected to said drive memeber (10) and being arranged to engage positively said seal elements (27, 28) for moving said seal elements (27, 28) outwardly toward said fluid chamber wall (23) during rotation of said drive member (10) relative to said output spindle (12).

2. Impulse generator according to claim 1, wherein said cam element (26) is rigidly attached to a central hub portion (25) on said drive member (10), said hub portion (25) extending into said bore (14).

3. Impulse generator according to claim 2, comprising at least two of said radial slots (29, 30) which are disposed diametrically opposite each other.

4. Impulse generator according to claim 3, wherein each of said seal elements (27, 28) comprises a cylindrical roller.

5. Impulse generator according to claim 2, wherein each of said seal elements (27, 28) comprises a cylindrical roller.

6. Impulse generator according to claim 1, comprising at least two of said radial slots (29, 30) which are disposed diametrically opposite each other.

7. Impulse generator according to claim 6, wherein each of said seal elements (27, 28) comprises a cylindrical roller.

8. Impulse generator according to claim 1, wherein each of said seal elements (27, 28) comprises a cylindrical roller.

* * * * *